United States Patent [19]

Hembert

[11] 4,388,142

[45] Jun. 14, 1983

[54] ELECTRICAL HARNESS FORMING MACHINE

[75] Inventor: Gaetan Hembert, Marck, France

[73] Assignee: Lucas Industries Limited, Birmingham, England

[21] Appl. No.: 214,770

[22] Filed: Dec. 9, 1980

[30] Foreign Application Priority Data

Dec. 20, 1979 [GB] United Kingdom ..... 7943840

[51] Int. Cl.[3] ..... B65C 1/00

[52] U.S. Cl. ..... 156/446; 29/755; 29/825; 156/499; 156/555

[58] Field of Search ..... 29/825, 850, 857, 755; 174/36; 156/562, 322, 436, 538, 446, 499, 555; 242/74, 74.1, 125.1

[56] References Cited

U.S. PATENT DOCUMENTS

| | | | |
|---|---|---|---|
| 3,149,930 | 9/1964 | Behncke | 34/122 X |
| 3,778,879 | 12/1973 | Den Ottolander | 29/825 X |
| 3,936,344 | 2/1976 | Ball et al. | 156/538 X |
| 4,071,393 | 1/1978 | Amphlett | 156/436 X |
| 4,168,580 | 9/1979 | Weinmann | 34/122 |

*Primary Examiner*—Lowell A. Larson
*Assistant Examiner*—Carl J. Arbes
*Attorney, Agent, or Firm*—Scrivener, Clarke, Scrivener and Johnson

[57] ABSTRACT

An electrical wiring harness is formed as a flat tape by securing individual leads side-by-side by a bonding material which is itself in the form of tape. With the bonding material in a potentially bond-forming condition, for example softened by heat, the leads and the bonding material are combined by pressure in a roll nip. It is known to lay the leads out along a work top and move a heating and combining unit along the leads to form the harness. However, the machine is very long, requires turntables at each end to turn the combining unit, and leaves the harness in an inconvenient form for further handling. The leads and bonding material 12 are drawn past combining means 40, 24, 26 by a winding drum 22, which winds up into the form of a coil a harness so formed.

7 Claims, 5 Drawing Figures

ELECTRICAL HARNESS FORMING MACHINE

This invention is concerned with a machine suitable for use in forming, and a production process for the manufacture of, an electrical wiring harness in the form of a tape by securing together a plurality of leads side-by-side.

A machine of that kind is described in U.K. Patent specification No. 1,429,652. In use of that machine, the leads are laid out on a work top of the machine and a mobile heating and tape-dispensing unit is moved along the work top, along the length of the laid-out leads, to secure the leads together by means of a thermoplastic backing tape; heat is applied to soften the tape, and the leads and the softened tape are combined by a roller. The leads, as presented to the machine, are individually insulated with thermoplastic sheaths, and some softening of the sheaths also takes place which aids securing of the leads. The heating and tape-dispensing unit can operate in only one direction and in order that it can be turned round and used in either direction along the work top, to save having to return it always to one end before use, there is a turntable at end end of the machine. After formation of a harness, the harness is removed from the work top by hand.

Although a machine as described in specification No. 1,429,652 has been found to be very satisfactory in many ways, it suffers from some disadvantages. Firstly, since the leads have to be fully laid out along the work top, and furthermore since a turntable is provided at each end of the work top, the machine is rather long and so occupies rather a lot of space. Secondly, it can be somewhat inefficient to have a mobile unit travelling backwards and forwards along the machine, and it is necessary to provide the turntables in order to avoid the further inefficiency of having to return the unit to one end of the machine before every harness-making operation. Thirdly, the completed harnesses are in an inconvenient form for handling and storage, and usually have to be subsequently coiled by hand.

It is an object of the present invention to provide an improved machine of the kind referred to in the last preceding paragraph but two.

In accordance with the invention a harness-forming machine, for use in forming an electrical wiring harness in the form of a tape by securing together side-by-side a plurality of leads which have terminal fittings prefitted at least on the leading ends thereof, comprises activating means comprising a hot-air blower operable to direct hot air at bonding material drawn therepast to cause it to assume a potentially bond-forming condition, combining means comprising opposed rollers providing a roll nip arranged to bring together the leads and the bonding material, in its potentially bond-forming condition, into a required tape form as the leads and the bonding material are drawn therethrough after the bonding material has been drawn past said hot-air blower, and lead drawing means arranged to cause the leads, and the bonding material therewith, to be drawn through the combining means and the harness so formed to be wound up into the form of a coil. The drawing means comprises winding means comprising lead holding means mounted on a winding drum, said lead holding means being arranged to engage the terminal fittings on the leading ends of the leads in order that the winding means can wind up the harness on the drum. One of the opposed rollers of the combining means is mounted for movement away from the other to permit the introduction of leads therebetween when setting up the machine to form a harness. The hot-air blower is mounted for movement between an operative position and an inoperative position to which it can be moved when not required in its operative position during formation of a harness.

The leads presented to the machine may be individually insulated or bare, and the bonding material may be provided by material already on the leads, or by material applied to bare leads in forming a harness (for example, material in the form of a tape), or by both. The lead holding means may comprise means providing at least one open-ended slot into which portions of the leads immediately behind the terminal fittings can be inserted, so that the terminal fittings will be engaged by the holding means upon rotation of the winding means. Preferably the holding means is pivotally mounted on or adjacent the periphery of a winding drum portion of the winding means, for pivotal movement about an axis extending longitudinally of the drum portion, the holding means comprising a portion which extends inwardly of the drum portion into a recess in the drum portion and provides said at least one open-ended slot.

By a machine according to the invention, a completed harness is delivered in a convenient form for further handling.

There now follows a description, to be read with reference to the accompanying drawings, of a machine and its operation which illustrate the invention by way of example.

Figure 1:
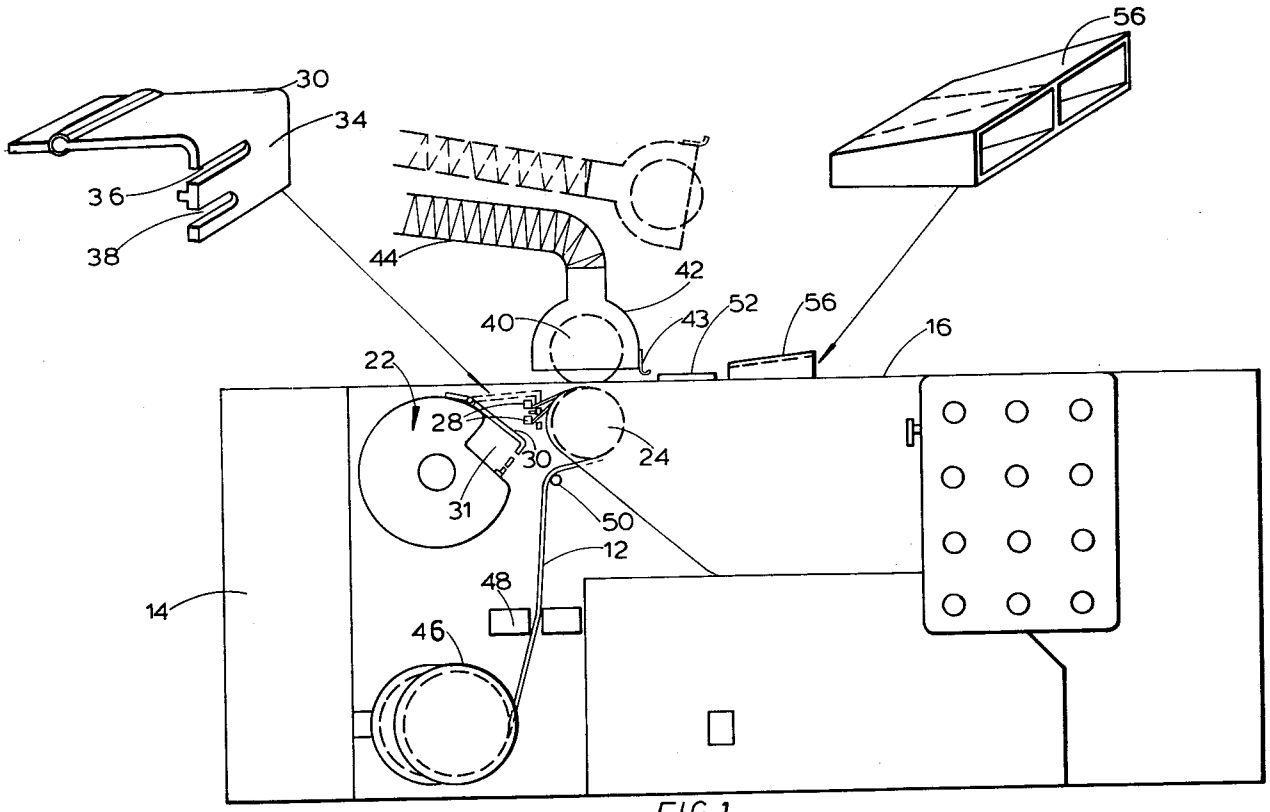
FIG. 1 is a view in elevation of the machine, with two components separately illustrated to a larger scale.

The machine is suitable for use in forming an electrical wiring harness in the form of a tape by securing together a plurality of leads 10 side-by-side by means of a heat-softenable material supplied in the form of a thermoplastic bonding tape 12. The machine is arranged so that two harnesses can be formed thereby simultaneously.

The machine comprises a machine frame 14 providing a work top 16. The work top is cut away from a front edge 18, (FIG. 2) to form an opening 20 above winding means 22 and support rollers 24 and 26.

The winding means 22 (FIG. 1) comprises a drum rotatable about a horizontal axis, and lead holding means mounted on the drum to engage behind terminal fittings 28 on leading ends of the leads 10. The lead holding means comprises two jigs, 30 and 32, which are pivotally secured side-by-side (axially of the drum) on the periphery of the drum for pivotal movement about an axis extending generally parallel to the rotational axis of the drum. The jigs are mounted in association with a recess 31 in the periphery of the drum. Each of the jigs comprises an inturned portion 34 (FIG. 1) in the form of a plate which extends generally radially inwardly of the drum into the recess 31. Each inturned portion 34 provides two open-ended slots 36 and 38, into which portions of the leads immediately behind the terminal fittings can be inserted; the inturned portion 34 is arranged so that upon rotation of the drum, it will engage back surfaces of the terminal fittings to draw the leads. The slots 36 and 38 extend generally longitudinally of the drum. The winding means is arranged to draw the leads 10 past heating means and combining means of the machine, and to wind up the harness, or harnesses, so formed into the form of a coil.

The combining means of the machine is arranged to combine the leads 10 and the thermoplastic tape 12, in a softened condition, to form a harness. The combining means comprises the support rollers 24 and 26 and two pressure rollers 40. The pressure rollers 40 are rotatably mounted on an extractor hood 42 attached to a conduit in the form of a flexible duct 44. The hood, and pressure rollers, can be swung between a withdrawn, inoperative, position (shown in dotted line in FIG. 1) and an operative position in which the pressure rollers oppose the support rollers to form roll nips. Tape supplying means of the machine, arranged to guide tape 12 to the roll nips from reels 46, comprises guides 48 and 50. Further guides 52, 54 and 56 are arranged on the work top 16 to guide the leads 10 into the roll nips, and a pneumatically and manually operable clamp 55 is provided to operate when necessary in association with the guide 54.

Figure 2:
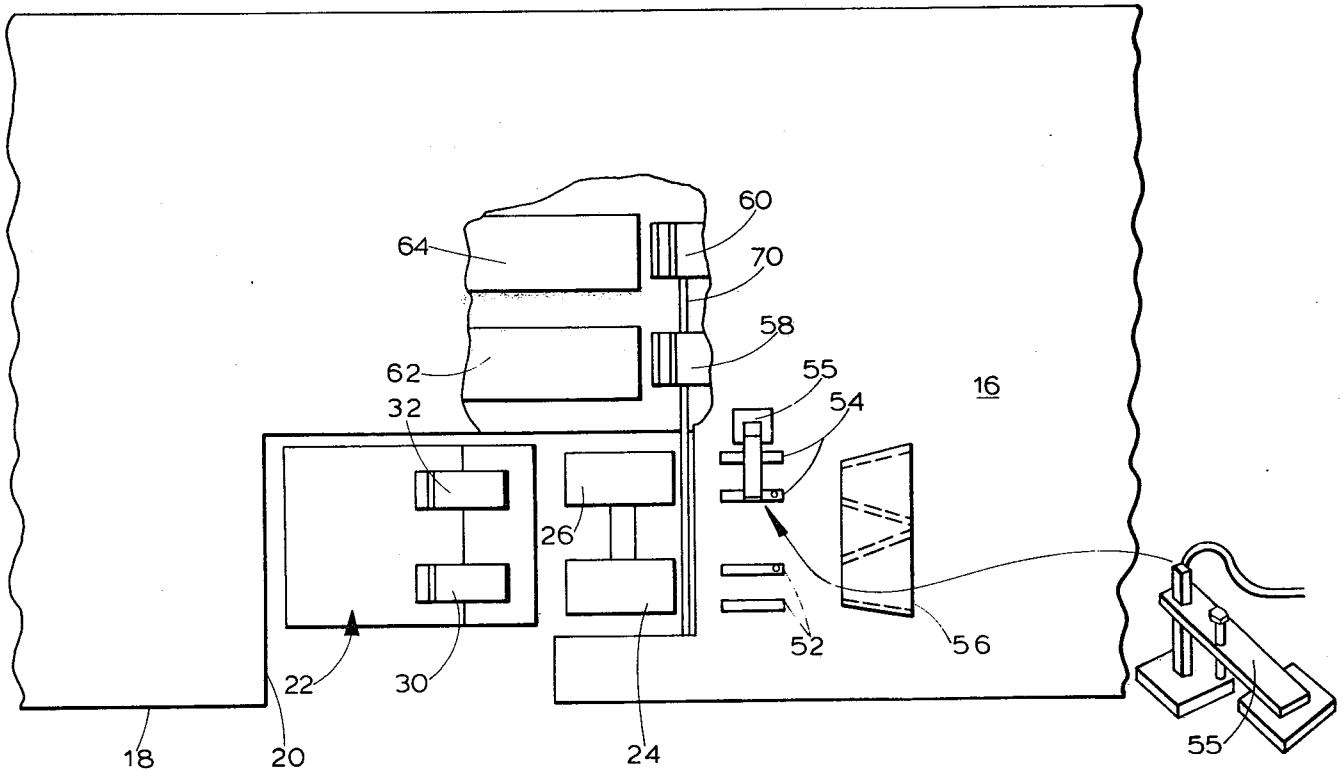
FIG. 2 is a plan view of the machine, with part of a work top of the machine broken away to shown components beneath.
Figure 3:
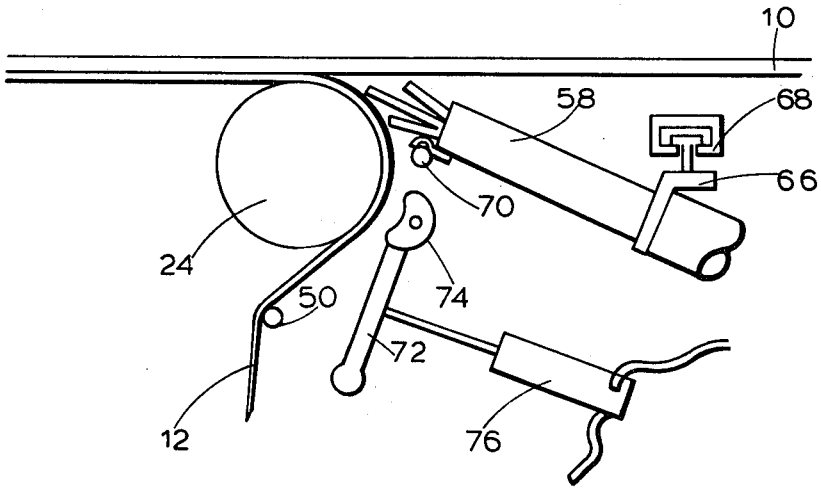
FIG. 3 is a view in elevation of components within the machine.
Figure 4:
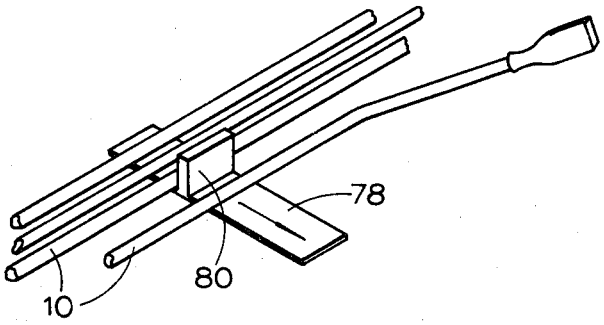
FIG. 4 is a view in perspective illustrating operation of a break-out device of the machine.

The heating means of the machine comprises two hot-air blowers 58 and 60 mounted to move, transversely of the work top, between an inoperative position, shown in FIG. 2, and an operative position in which they are directed generally towards the two roll nips. In the inoperative position, the blowers are directed generally towards escape ducts 62 and 64 by which hot air issuing from the blowers can be lead away. Brackets 66 secured to the blowers are arranged to run along a slot in a guide rail 68 from which they depend, and forward end portions of the blowers rest on a guide bar 70 along which they can slide. Means (not shown) is provided for moving the blowers between their inoperative and operative positions.

The machine comprises tape severing means comprising two pivotally mounted arms 72 carrying clamping heads 74. Pneumatic cylinders 76 are arranged to move the arms 72 to and from positions in which the clamping heads 74 can trap the tapes 12 against the peripheries of the support rollers 24 and 26.

The machine comprises separating means arranged to be operated at a predetermined position along the length of a harness being formed in use of the machine, to break out one lead so that that lead, from said predetermined postion in the harness onwards, is prevented from being combined into the harness by the combining means.

This facilitates automatic ejection of an outside lead from the main body of the harness, whilst the machine is still in motion, eliminating the need to stop the machine and withdraw the lead by hand. The separating means is in the form of a break-out device comprising a horizontal slide 78 comprising an upwardly-projecting finger 80. The slide is arranged to be reciprocated by an air cylinder (not shown) which operates automatically in accordance with the machine programme.

In operation of the machine to form a harness, leads 10 are selected from supply racking (not shown) as required to make up the harness. [For simplicity the formation of only one harness will be described.] The leads are drawn manually through the guides 56 and 52 and over the support roller 24 (the hood 42 being in its inoperative position), to trap the leading end of one tape 12 against the support roller 24. With terminal fittings 28 on the leading ends of the leads, the leads are introduced into the slots 36 and 38 of the jig 30, so that the leads become secured to the winding means. The hood 42 is then lowered to its operative position to trap the leads side-by-side on the tape 12 in the roll nip, and the blower 58 moved to its operative position. Upon rotation of the drum of the winding means, the leads are drawn by the winding means along the work top, past the blower 58, through the roll nip between the support roller 24 and the pressure roller 40, where they are combined with the tape 12, and the resultant harness is wound up on the drum into the form of a coil. The blower 58 is operated to heat the thermoplastic tape 12, and thermoplastic insulating material on the leads 10, to soften the thermoplastic material and bring it to a potentially bond-forming condition just prior to entry into the roll nip, so that the leads and the tape, compressed in the roll nip, become secured together to form a harness. Any fumes generated are led away by extracting means (not shown) through the hood 42 and the duct 44. Approaching completion of the harness, the cylinder 76 is actuated to press the clamping head 74 against the tape on the support roller 24, which causes the tape to break as winding of the harness continues. The clamping head is maintained in clamping position until the next cycle of operation, to keep control of the otherwise loose end of the tape. Upon completion of the harness the operator can simply slip the coiled harness from the winding means, axially from the drum, and the harness is in a convenient coiled form for further handling and storage.

The machine might be programmed to stop automatically at intervals, in each cycle of operation, to allow an operator to withdraw a lead when that lead is required to be let out from the harness. For this purpose, a pulse generator could be used in association with the winding means, to indicate when a required stopping position has been reached. However, the machine can be programmed to operate automatically the slide 78 of the break-out device, to withdraw a lead without stopping the machine.

Figure 5:
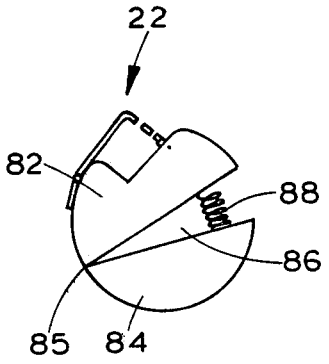
FIG. 5 illustrates an alternative form of winding drum.

In an alternative form, the winding means 22 may comprise a drum portion which can be partially collapsed radially to reduce its cross-section, to ease removal of a coiled harness. In the form shown in FIG. 5, two parts 82 and 84 of a winding drum portion of the winding means are connected together for relative pivotal movements, about an axis 85 extending longitudinally of the drum portion, and have a space 86 between them when the drum portion is fully expanded. The two parts can be pivotally moved towards one another to partially collapse the drum portion. A compression spring 88 is provided to resiliently urge the two parts 82 and 84 apart. Pneumatic, hydraulic or other actuating means (not shown) may be provided to relatively move the parts.

What is claimed is:

1. A harness-forming machine for use in forming an electrical wiring harness in the form of a tape by securing together side-by-side a plurality of leads which have terminal fittings pre-fitted at least on the leading ends thereof, the machine comprising activating means comprising a hot-air blower operable to direct hot air at bonding material drawn therepast to cause it to assume a potentially bond-forming condition, combining means comprising opposed rollers providing a roll nip arranged to bring together the leads and the bonding material, in its potentially bond-forming condition, into a required tape form as the leads and the bonding material are drawn therethrough after the bonding material has been drawn past said hot-air blower, and lead drawing means arranged to cause the leads, and the bonding material therewith, to be drawn through the combining means and the harness so formed to be wound up into the form of a coil, said drawing means comprising winding means comprising lead holding means mounted on a winding drum, said lead holding means being arranged to engage the terminal fittings on the leading ends of the leads in order that the winding means can wind up the harness on the drum, one of said opposed rollers of the combining meand being mounted for movement away from the other to permit the introduction of leads therebetween when setting up the machine to form a harness, and said hot-air blower being mounted for movement between an operative position and an inoperative position to which it can be moved when not required in its operative position during formation of a harness.

2. A machine according to claim 1 in which an upper one of the rollers is mounted in association with an extractor hood from which a conduit leads to extracting means, the roller and the hood being movable towards and away from the other of the two rollers between withdrawn and operative positions.

3. A machine according to claim 1 in which said lead holding means comprises means providing at least one open-ended slot into which portions of the leads immediately behind the terminal fittings can be inserted, so that the terminal fittings will be engaged by the holding means upon rotation of the winding means.

4. A machine according to claim 3 in which the holding means is pivotally mounted on or adjacent the periphery of the drum, for pivotal movement about an axis extending longitudinally of the drum, the holding means comprising a portion which extends inwardly of the drum into a recess in the drum and provides said at least one open-ended slot.

5. A machine according to claim 1 in which the winding means comprises a drum portion which can be partially collapsed radially to ease removal of a coiled harness.

6. A machine according to claim 1 comprising separating means arranged to be operated at a predetermined position along the length of a harness being formed, in use of the machine, to break out a lead so that that lead, from said predetermined position in the harness onwards, is prevented from being combined into the harness by the combining means.

7. A machine according to claim 1 comprising tape supplying means arranged to guide a bonding tape to the combining means for combination of the bonding tape with the leads in formation of a harness.

* * * * *